US008075032B2

(12) United States Patent
Bovaird et al.

(10) Patent No.: US 8,075,032 B2
(45) Date of Patent: Dec. 13, 2011

(54) SAFETY SLING FOR A TIRE CURING MACHINE

(75) Inventors: Lorie Jean Bovaird, Hudson, OH (US); William Frederick Niessen, Cuyahoga Falls, OH (US); William Andrew Haydu, Jr., Akron, OH (US); Daniel Dale Enix, Ravenna, OH (US); McAllister Daniel, Jr., Akron, OH (US)

(73) Assignee: The Goodyear Tire & Rubber Company, Akron, OH (US)

( * ) Notice: Subject to any disclaimer, the term of this patent is extended or adjusted under 35 U.S.C. 154(b) by 302 days.

(21) Appl. No.: 12/535,840

(22) Filed: Aug. 5, 2009

(65) Prior Publication Data

US 2011/0031770 A1 Feb. 10, 2011

(51) Int. Cl.
*B66C 1/12* (2006.01)

(52) U.S. Cl. ..... 294/74

(58) Field of Classification Search ..... 294/74, 294/140–141, 149, 150–152, 157, 165; 5/89.1, 5/81.1 T; 224/579, 580, 609, 611; 119/769, 119/786, 788, 791; 248/320, 317; 2/301, 2/304, 305, 309, 312, 315, 323, 326, 338
See application file for complete search history.

(56) References Cited

U.S. PATENT DOCUMENTS 878,044 A * 2/1908 Hanson ..... 418/117
2,386,034 A * 10/1945 Church ..... 294/97
2,431,780 A * 12/1947 Theal ..... 224/157
4,174,940 A 11/1979 Pizzorno ..... 425/577
4,395,209 A 7/1983 Singh et al. ..... 425/33
4,606,714 A 8/1986 Nixon et al. ..... 425/28 R
4,921,412 A 5/1990 Scantland et al. ..... 425/28.1
5,316,458 A 5/1994 Lesneski ..... 425/34.1
5,803,324 A * 9/1998 Silberman et al. ..... 224/42.23
5,939,002 A 8/1999 Heindel ..... 264/219
6,039,376 A * 3/2000 Lopreiato ..... 294/152
(Continued)

FOREIGN PATENT DOCUMENTS

JP 06-182768 7/1994
(Continued)

*Primary Examiner* — Saul Rodriguez
*Assistant Examiner* — Stephen Vu
(74) *Attorney, Agent, or Firm* — Robert N. Lipcsik

(57) ABSTRACT

A safety sling secures an upper mold section of a tire press. The safety sling includes a first link, a second link, a third link, and a fourth link. The second link is connected to the first link by a first strap section. The third link is connected to the second link by a second strap section. The fourth link is connected to the link ring by a third strap section. The fourth link is also connected to the first link by a fourth strap section to define a quadrilateral configuration. The first link is connected to a link ring by a fifth strap section. The second link is connected to a sixth link by a sixth strap section. The third link is connected to a seventh link by a seventh strap section. The fourth link is connected to an eighth link by an eighth strap section such that the fifth, sixth, seventh, and eighth links are secured to the tire press for allowing the safety sling to catch the upper mold section in the event the upper mold section becomes otherwise unsecured from the tire press.

1 Claim, 2 Drawing Sheets

U.S. PATENT DOCUMENTS

| | | | | |
|---|---|---|---|---|
| 6,292,993 | B1 | 9/2001 | Ito et al. | 29/426.1 |
| 6,315,539 | B1 | 11/2001 | Yutronkie et al. | 425/28.1 |
| 6,374,776 | B2 * | 4/2002 | Adair et al. | 119/771 |
| 6,506,040 | B1 | 1/2003 | Singh | 425/28.1 |
| 6,508,389 | B1 * | 1/2003 | Ripoyla et al. | 224/157 |
| 6,716,013 | B2 | 4/2004 | Fike | 425/46 |
| 2008/0141950 | A1 * | 6/2008 | Glazer | 119/770 |

FOREIGN PATENT DOCUMENTS

| | | |
|---|---|---|
| JP | 2005131819 | 5/2005 |
| JP | 2005254464 | 9/2005 |
| JP | 2006321227 | 11/2006 |

* cited by examiner

SAFETY SLING FOR A TIRE CURING MACHINE

FIELD OF THE INVENTION

The present invention relates to tire molds of a tire curing machine, and more specifically, to an apparatus for securing an upper mold during routine maintenance of the tire curing machine.

BACKGROUND OF THE INVENTION

A conventional segmented mold for curing pneumatic tires utilizes upper and lower mold sections, with the upper mold section being vertically movable with respect to the bottom mold section between a raised open position and a lower closed position. The interior of the top and bottom mold sections are bowl-shaped and each contain a plurality of arcuate tread segments arranged in a circular pattern. The tread segments are each formed with radially inward extending tread groove-defining lugs. When the upper mold section is in its open raised position, the tread segments of the mold section are arranged radially outward of the outer diameter of the uncured, or "green," tire to be vulcanized and molded. When the top mold section is moved to its closed lower position, the tread segments of both the top and bottom mold sections are automatically cammed radially inward by the sloping sides of the bowls of such mold sections so that the tread-defining lugs of die segments engage the uncured crown of the green tire for curing of the green tire. As the tread segments of the lower mold section move radially inward, they travel downwardly along the sloping sides of the lower mold section bowl. When the tire has been cured, the top mold section is raised and the upper and lower tread segments automatically move outwardly from the cured tire so that such tire can be withdrawn from the bottom mold section.

The top and bottom mold sections of a conventional segmented mold are generally formed of steel while the tread segments are formed of aluminum, steel, or iron. The tire curing operation requires that the mold sections be heated to a high temperature, with heat from the mold sections being transferred to the tread segments. The outer surface of the tread segments have a curvature that match the inner arcuate surface of the upper and lower mold sections only when the tread segments have traveled inwardly to their closed tire molding position. When the tread segments are arranged in their open position, the curvature of their outer surface is less than the curvature of the inner surface of their respective mold sections. Accordingly, the contact area between the rear outer surface of the tread segments and the inner surface of the bowl of the mold sections varies as the tread segments travel vertically towards their fully closed position within the bowls of the upper and lower mold section bowls. Such contact area is narrow at the open position of the tread segments and about equal to the width of the tread segments when the tread segments are at their closed position.

As the tread segments slide vertically along the sloping sides of the bowls of the upper and lower mold sections, the lugs engage the uncured circumferential area of the green tire thereby causing the uncured rubber of the green tire to force the tread segments radially outward with considerable pressure. Simultaneously, vertical travel of the tread segments creates a radially inward directed force upon the tread segments causing the tread segments to generate considerable friction as they slide along the inner surface of the steel bowls of the open lower mold segments. Where the tread segments are formed of aluminum, such friction can often result in an instantaneous binding of a small area of the aluminum material on the outer surface of a tread segment to the inner surface of the steel material of the mold segment bowl. This binding can effect instantaneous tearing of a portion of the tread segment aluminum material out of the outer surface of such tread segment.

When this occurs, particles of the aluminum material will be torn away from the rear surface of the tread segments so as to define a vertically extending groove in the outer surface of the tread segment as the tread segment undergoes vertical travel towards its closed position. The aluminum particles torn out of the groove may ball-up in the space between the outer surface of the tread segment and the inner surface of the mold bowl, so as to wedge the affected tread segment radially inward away from contact with the bowl thereby creating a gap between the outer surface of the tread segment and the inner surface of the bowl. Such gap blocks the flow of heat from the mold section into the damaged tread segment whereby the temperature of the tread segment adjacent the gap is reduced to the extent that undercuring of the tire can occur adjacent the gap.

Also, since the damaged tread segment is forced radially inward away from the bowl, the tire may assume an out-of-round shape when it is being cured. It then becomes necessary to remove the affected tread segment from the mold bowl, file off the balled-up tread segment material, apply new lubricant to the rear surface of the tread segments, as well as the inner surface of the mold section bowl, and replace the repaired tread segment in the bowl. These corrective operations, as well as others, are lengthy and labor intensive and also preclude use of the mold to cure tires during such corrective operations. If the tread segments are formed of steel, such segments may also fuse to the bowl as they slide along the inner surface of the bowl.

As a result, it is possible that the upper mold section may be in the open, raised position for an extended period of time while operators work underneath the raised mold section. Any safety measure for ensuring that the upper mold section is more secure during such maintenance would be desirable.

SUMMARY OF THE INVENTION

A safety sling in accordance with the present invention secures an upper mold section of a tire press. The safety sling includes a first link, a second link, a third link, and a fourth link. The second link is connected to the first link by a first strap section. The third link is connected to the second link by a second strap section. The fourth link is connected to the third link by a third strap section. The fourth link is also connected to the first link by a fourth strap section to define a quadrilateral configuration. The first link is connected to a fifth link by a fifth strap section. The second link is connected to a sixth link by a sixth strap section. The third link is connected to a seventh link by a seventh strap section. The fourth link is connected to an eighth link by an eighth strap section such that the fifth, sixth, seventh, and eighth links are secured to the tire press for allowing the safety sling to catch the upper mold section in the event the upper mold section becomes otherwise unsecured from the tire press.

According to another aspect of the present invention, the quadrilateral configuration is a square configuration.

According to still another aspect of the present invention, the first, second, third and fourth links are rings with a triangular shape.

According to yet another aspect of the present invention, the fifth, sixth, seventh, and eighth links have a triangular shape.

According to still another aspect of the present invention, the first, second, third and fourth strap sections are constructed of woven fabric.

According to yet another aspect of the present invention, the fifth, sixth, seventh, and eighth strap sections are constructed of woven fabric.

BACKGROUND DEFINITIONS

"Aspect Ratio" means the ratio of a tire's section height to its section width.

"Axial" and "axially" means the lines or directions that are parallel to the axis of rotation of the tire.

Bead" or "Bead Core" means generally that part of the tire comprising an annular tensile member, the radially inner beads are associated with holding the tire to the rim being wrapped by ply cords and shaped, with or without other reinforcement elements such as flippers, chippers, apexes or fillers, toe guards and chafers.

"Belt Structure" or "Reinforcing Belts" means at least two annular layers or plies of parallel cords, woven or unwoven, underlying the tread, unanchored to the bead, and having both left and right cord angles in the range from 17° to 27° with respect to the equatorial plane of the tire.

"Bias Ply Tire" means that the reinforcing cords in the carcass ply extend diagonally across the tire from bead-to-bead at about 25-65° angle with respect to the equatorial plane of the tire, the ply cords running at opposite angles in alternate layers "Breakers" or "Tire Breakers" means the same as belt or belt structure or reinforcement belts.

"Carcass" means a laminate of tire ply material and other tire components cut to length suitable for splicing, or already spliced, into a cylindrical or toroidal shape. Additional components may be added to the carcass prior to its being vulcanized to create the molded tire.

"Circumferential" means lines or directions extending along the perimeter of the surface of the annular tread perpendicular to the axial direction; it can also refer to the direction of the sets of adjacent circular curves whose radii define the axial curvature of the tread as viewed in cross section.

"Cord" means one of the reinforcement strands, including fibers, which are used to reinforce the plies.

"Inner Liner" means the layer or layers of elastomer or other material that form the inside surface of a tubeless tire and that contain the inflating fluid within the tire.

"Inserts" means the reinforcement typically used to reinforce the sidewalls of runflat-type tires; it also refers to the elastomeric insert that underlies the tread.

"Ply" means a cord-reinforced layer of elastomer-coated, radially deployed or otherwise parallel cords.

"Radial" and "radially" mean directions radially toward or away from the axis of rotation of the tire.

"Radial Ply Structure" means the one or more carcass plies or which at least one ply has reinforcing cords oriented at an angle of between 65° and 90° with respect to the equatorial plane of the tire.

"Radial Ply Tire" means a belted or circumferentially-restricted pneumatic tire in which the ply cords which extend from bead to bead are laid at cord angles between 65° and 90° with respect to the equatorial plane of the tire.

"Sidewall" means a portion of a tire between the tread and the bead.

"Laminate structure" means an unvulcanized structure made of one or more layers of tire or elastomer components such as the innerliner, sidewalls, and optional ply layer.

BRIEF DESCRIPTION OF THE DRAWINGS

The invention will be described by way of example and with reference to the accompanying drawings in which.

DETAILED DESCRIPTION OF THE INVENTION

Figure 1:
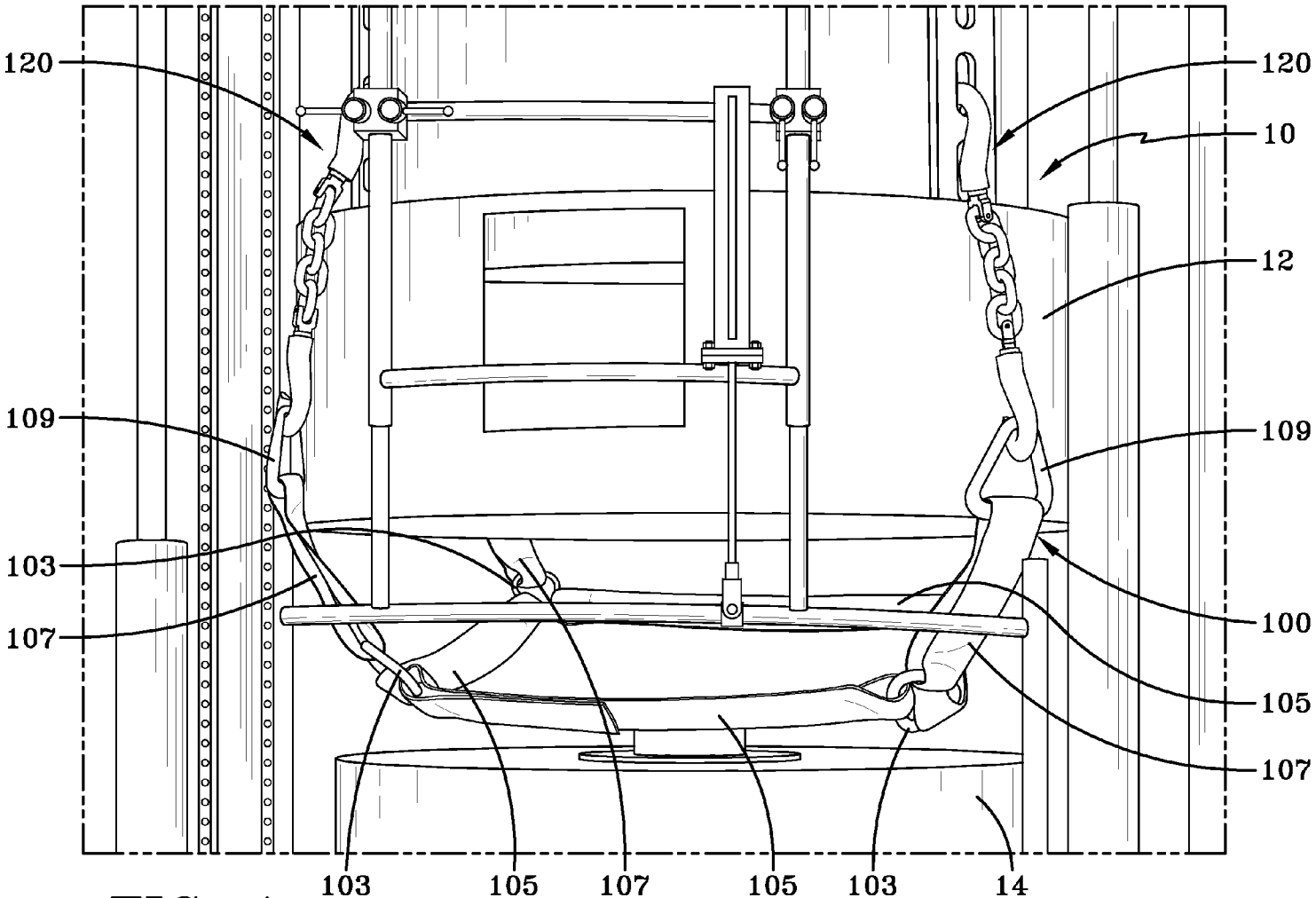
FIG. 1 is a schematic representation of a safety sling in accordance with the present invention installed on a tire curing machine.

Referring to the drawings, a tire curing machine, or tire press 10, for use with the present invention is shown having an upper mold section 12 and a lower mold section 14 for curing pneumatic tires. These mold sections 12, 14 may also be of a sectional type for certain applications as, for example, the curing of truck tires. In the upper half of the tire press 10, a central opening well for receiving a bead elevator means may be lowered into the space between the mold sections 12, 14 or retracted into the central opening.

In operation, the tire press 10 may be opened, as shown in FIG. 1, providing a space between the upper mold section 12 and lower mold section 14. A tire may be placed in the space in axial alignment with the upper and lower mold sections 12, 14.

The upper mold section 12 may then be lowered to a closed position of the tire press 10 (not shown). A curing bladder may then be inflated for inserting into the tire cavity and completely filling the tire cavity. Steam or hot water may be injected into the curing bladder and the mold sections heated for vulcanizing and shaping the tire.

After the tire has been shaped and vulcanized and the curing medium discharged, the curing bladder may be removed from the tire. The upper mold section 12 may be raised and the tire disengaged from the upper mold section 12 and then the lower mold section 14.

As stated above, the tire press 10 may be in the open position (FIG. 1) for extended periods of time during maintenance. Accordingly, a safety sling 100 in accordance with the present invention may be temporarily placed around the upper mold section 12 to prevent the upper mold section from inadvertently falling into the space between the upper and lower mold sections 12, 14.

As shown in FIG. 1, the safety sling 100 may be secured to four hook/chain assemblies 120 (two shown) thereby allowing the safety sling to "catch" the upper mold section 12 should it become unsecured. Any maintenance worker underneath the upper mold section at such a time would thus be protected from being crushed by the upper mold section.

Figure 2:
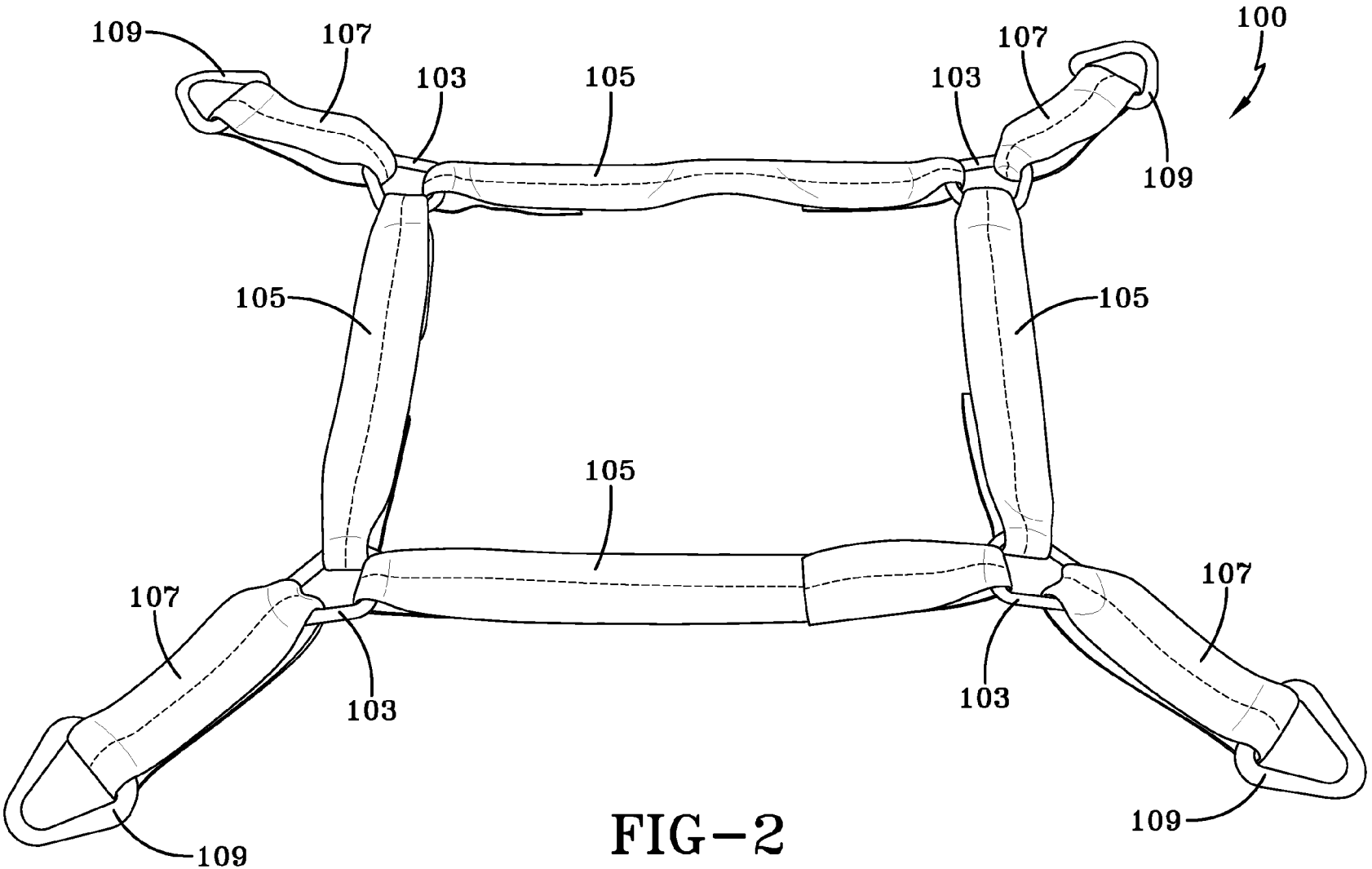
FIG. 2 is a schematic representation of the safety sling of FIG. 1 in an uninstalled condition.

As shown in FIG. 2, the safety sling 100 may comprise a generally quadrilateral (i.e., square) central portion with a projection extending from each corner of the square. An approximately triangular link or ring 103 may be placed at each corner with connecting straps 105 interconnecting the other links or rings of the square and also straps 107 interconnecting each corner to another triangular link or ring 109 for connecting to tire press 10, such as by the hook/chain assemblies 120. The links 103, 109 may alternatively be hooks or any other suitable connection means. The straps 107 may alternatively be chains or any other suitable connection means.

The straps 105, 107 may be looped through the rings 103, 109, doubled back, and sewn to provide suitable strength to support an upper mold section 12. The straps 105, 107 may be constructed of any suitable fabric or flexible material, such as woven nylon. The rings 103, 109 may be constructed of any suitable material, such as steel.

Variations in the present invention are possible in light of the description of it provided herein. While certain representative embodiments and details have been shown for the purpose of illustrating the subject invention, it will be apparent to those skilled in this art that various changes and modifications can be made therein without departing from the scope of the subject invention. It is, therefore, to be understood that changes can be made in the particular embodiments described which will be within the full intended scope of the invention as defined by the following appended claims.

What is claimed is:

1. A safety sling configured to secure to an upper mold section of a tire press, the safety sling comprising:

a first link;

a second link connected to the first link by a first strap section;

a third link connected to the second link by a second strap section;

a fourth link connected to the third link by a third strap section, the fourth link also connected to the first link by a fourth strap section to define a square configuration, the first link being connected to a fifth link by a fifth strap section, the second link being connected to a sixth link by a sixth strap section, the third link being connected to a seventh link by a seventh strap section, and the fourth link being connected to an eighth link by an eighth strap section such that the fifth, sixth, seventh, and eighth links are secured to the tire press for allowing the safety sling to catch the upper mold section in the event the upper mold section becomes otherwise unsecured from the tire press, the first, second, third, fourth, fifth, sixth, seventh, and eighth links being rings with a triangular shape, the first, second, third, fourth, fifth, sixth, seventh, and eighth strap sections being constructed of woven fabric, whereby the safety sling supports the full weight of the upper mold section upon the upper mold section becoming unsecured.

* * * * *